US008215909B2

(12) United States Patent
Groβ

(10) Patent No.: US 8,215,909 B2
(45) Date of Patent: Jul. 10, 2012

(54) TURBINE BLADE

(75) Inventor: Heinz-Jürgen Groβ, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 535 days.

(21) Appl. No.: 12/513,682

(22) PCT Filed: Oct. 18, 2007

(86) PCT No.: PCT/EP2007/061127

§ 371 (c)(1),
(2), (4) Date: May 6, 2009

(87) PCT Pub. No.: WO2008/055764

PCT Pub. Date: May 15, 2008

(65) Prior Publication Data

US 2010/0054952 A1 Mar. 4, 2010

(30) Foreign Application Priority Data

Nov. 9, 2006 (EP) ..... 06023377

(51) Int. Cl.
*F01D 5/18* (2006.01)

(52) U.S. Cl. ..... 416/96 A; 416/96 R

(58) Field of Classification Search ..... 415/115; 416/96 R, 96 A, 97 R
See application file for complete search history.

(56) References Cited

U.S. PATENT DOCUMENTS

| | | | | |
|---|---|---|---|---|
| 4,416,585 | A * | 11/1983 | Abdel-Messeh | 416/97 R |
| 5,395,212 | A | 3/1995 | Anzai et al. | |
| 5,472,316 | A | 12/1995 | Taslim et al. | |
| 5,695,321 | A | 12/1997 | Kercher | |
| 5,919,031 | A * | 7/1999 | Hall et al. | 416/96 R |
| 6,068,445 | A * | 5/2000 | Beeck et al. | 416/96 R |
| 2004/0022630 | A1 * | 2/2004 | Tiemann | 416/97 R |
| 2006/0051208 | A1 * | 3/2006 | Lee et al. | 416/97 R |
| 2007/0297916 | A1 * | 12/2007 | Levine et al. | 416/96 R |
| 2007/0297917 | A1 * | 12/2007 | Levine et al. | 416/96 R |

FOREIGN PATENT DOCUMENTS

| | | | |
|---|---|---|---|
| DE | 19526917 | A1 | 1/1997 |
| EP | 1380724 | A2 | 1/2004 |
| EP | 1637699 | A2 | 3/2006 |
| JP | 2006077767 | A | 3/2006 |

OTHER PUBLICATIONS

Communication from Japanese Patent Office, Nov. 28, 2011, pp. 1-6.

* cited by examiner

*Primary Examiner* — Christopher Verdier

(57) ABSTRACT

A turbine blade comprising a plurality of ribs arranged one after the other in a cooling channel extending along a leading edge is provided. The plurality of ribs is split into pairs of ribs formed by two ribs arranged in the form of a skating step.

9 Claims, 1 Drawing Sheet

TURBINE BLADE

CROSS REFERENCE TO RELATED APPLICATIONS

This application is the US National Stage of International Application No. PCT/EP2007/061127, filed Oct. 18, 2007 and claims the benefit thereof. The International Application claims the benefits of European Patent Office application No. 06023377.2 EP filed Nov. 9, 2006, both of the applications are incorporated by reference herein in their entirety.

FIELD OF INVENTION

The invention refers to a turbine blade. Turbine blades, especially turbine blades for gas turbines, are exposed to high temperatures during operation, which quickly exceed the limit of material stress. This especially applies to the regions in the vicinity of the flow inlet edge. In order to be able to use turbine blades even at high temperatures it has already been known for a long time to suitably cool turbine blades so that they have a higher resistance to temperature. With turbine blades which have a higher resistance to temperature, higher energy efficiencies in particular can be achieved.

BACKGROUND OF INVENTION

Known types of cooling are inter alia convection cooling, impingement cooling and film cooling. In the case of convection cooling, it is probably the most common type of blade cooling. With this type of cooling, cooling air is guided through passages inside the blade and the convective effect is utilized in order to dissipate the heat. In the case of impingement cooling, a cooling air flow from the inside impinges upon the blade surface. In this way, a very good cooling effect is made possible at the point of impingement, but which is limited only to the narrow region of the impingement point and the immediate vicinity. This type of cooling is therefore mostly used for cooling the flow inlet edge of a turbine blade which is exposed to high temperature stresses. In the case of film cooling, cooling air is guided from inside the turbine blade outwards via openings in the turbine blade. This cooling air flows around the turbine blade and forms an insulating layer between the hot process gas and the blade surface. The described types of cooling, depending upon the application case, are suitably combined in order to achieve blade cooling which is as effective as possible.

In addition to the types of cooling which are described above, the use of cooling means, such as turbulators, which in most cases are provided in the form of small ribs, is very common and known for example from EP 1 637 699 A2. The ribs are arranged inside the cooling passages which are provided for the convection flow and extend inside the turbine blade. The installation of ribs in the cooling passages causes the flow of cooling air in the boundary layers to be separated and swirled. As a result of the disturbance of the flow which is forced in this way, heat transfer can be increased in the case of an existing temperature difference between the cooling passage wall and cooling air. As a result of the ribbing, the flow constantly causes new "re-attachment fields" to be formed, in which a significant increase of the local heat transfer coefficient can be achieved.

For cooling the flow inlet edge, or leading edge, of turbine blades, which during operation is thermally very severely stressed in most cases, cooling passages, which extend parallel to and close to the flow inlet edge, are often formed in turbine blades, to which cooling passages cooling air is fed by means of further cooling passages which are formed in the blades. The convective cooling of the flow inlet edge which is realized in this way is supplemented in the case of film-cooled blades mostly by means of impingement cooling of the inside wall of the cooling passage which extends close to the flow inlet edge. In applications in which no film cooling of the turbine blades is undertaken, the convective cooling is intensified by means of turbulators which are arranged on the inside wall of the cooling passage.

SUMMARY OF INVENTION

Both in the case of film-cooled blades and in the case of blades which are not film-cooled there is currently still a clear need for improvement with regard to the cooling of the flow inlet edge.

The invention is based on the object of disclosing a turbine blade, the flow inlet edge of which can be cooled more effectively compared with known solutions, in fact both in the case of existing film cooling and in the case of non-existent film cooling.

This object is achieved according to the invention with a turbine blade which has a plurality of ribs which are arranged one after the other in a cooling passage which extends along a flow inlet edge, and in which with two ribs a rib-pair is formed in each case, the ribs of which pair are arranged in skating-step form.

Compared with known solutions, the paired arrangement of the ribs in skating-step form, which is provided according to the invention, brings about a greatly increased swirling of the cooling air which flows in the cooling passage according to the invention in such a way that the cooling air which flows in the cooling passage is directed from one rib of a rib-pair to the other rib of the rib-pair. A greatly increased local heat transfer coefficient is associated with the greatly increased swirling of the cooling air so that when considered overall a noticeably more effective cooling, especially in the region of the flow inlet edge, can be provided compared with known solutions. When considered overall, the turbine blade according to the invention can therefore be exposed to higher gas temperatures even if no film cooling is provided. If film cooling is provided, still higher gas temperatures are possible. In addition, a high degree of turbulence develops on the ribs which are exposed to inflow, which in combination with impingement cooling effects and a marked surface enlargement on the cooling air side leads to an efficient utilization of cooling air and a homogenization of the temperature distribution.

Furthermore, according to the invention, the two ribs of a rib-pair are formed in each case as a guiding element for a core flow of a cooling medium which flows in the cooling passage in such a way that the ribs guide the core flow from one rib of the rib pair essentially transversely to the other rib of the rib-pair. As a result of this flow-guiding, which is provided according to the invention, of the cooling air which flows in the cooling passage, an especially large portion of the cooling medium flow, specifically of the cooling medium flow which flows in the center of the passage, is guided against the side surfaces of the downstream ribs as an impingement cooling jet so that in the region of the rib-pair a very high local heat transfer coefficient and a correspondingly intensely formed cooling effect can be achieved.

A core flow of the medium which flows in the cooling passage is described by the portion of the cooling medium which flows essentially in the center of the passage, i.e. which does not flow essentially along the passage walls. Correspondingly, the ribs according to the invention are not turbulators in the sense of EP 1 637 699 A2 but guiding elements with which a significant portion of the cooling medium can be deflected or diverted in each case.

In a practical development of the invention, the two ribs of a rib-pair include a prespecified angle, and an overall cooling capability of the two ribs of a rib-pair is adapted, via the angle, to a predetermined cooling requirement for the flow inlet edge in the vicinity of the rib-pair.

According to the invention, by changing the angular position of the ribs of a rib-pair the extent of swirling of the cooling air, and therefore also the local heat transfer coefficient, can be purposefully influenced so cooling which is adapted to a local cooling requirement for the flow inlet edge can be realized. In this case, according to the invention, the cooling capability of a rib-pair can be increased by increasing the angle which is included by the two ribs of the rib-pair. When considered overall, by means of this practical development the temperature distribution on the flow inlet edge can be "homogenized" since according to the invention a correspondingly intense cooling is carried out and vice versa at comparatively hot places of the flow inlet edge by suitably designed rib-pairs so that an effective cooling of the flow inlet edge can be realized, which counteracts an inhomogeneous temperature distribution.

An inhomogeneous temperature distribution is associated with large thermal stresses which have a disadvantageous effect on the service life of the turbine. This especially applies to turbine blades which are used in turbines which are axially exposed to throughflow, in which an inhomogeneous temperature distribution develops for the flow inlet edge along the radial direction.

In a further practical development, the ribs extend from one wall which delimits the cooling passage and project into the cooling passage, wherein the ribs are preferably formed in one piece with the delimiting wall.

In an advantageous development of the invention, the rib-pairs are attached inside an insert which is inserted into the cooling passage. In this way, an insert is provided according to the invention which if necessary can be removed from the turbine blade, preferably in the form of a stator blade, for example in order to adapt the angular position of the rib-pairs to a given application. Likewise the casting of the turbine blade can also be kept simple in this way, so that the turbine blade according to the invention can also be produced without expensively designed casting cores.

In a further advantageous development of the invention, the cooling passage extends essentially parallel to the flow inlet edge, or leading edge, continuously through the turbine blade in order to provide an effective cooling along the entire extent of the flow inlet edge.

BRIEF DESCRIPTION OF THE DRAWINGS

An exemplary embodiment of a turbine blade according to the invention is subsequently explained in more detail with reference to the attached drawings. In the drawings.

DETAILED DESCRIPTION OF INVENTION

Figure 1:
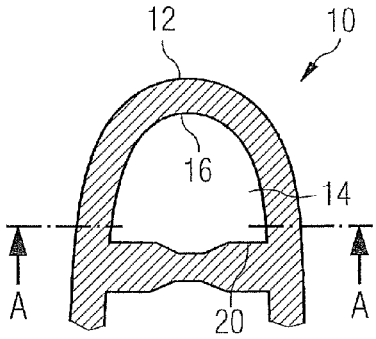
FIG. 1 shows a rough sectional view of a turbine blade according to the invention through its flow inlet edge.
Figure 3:
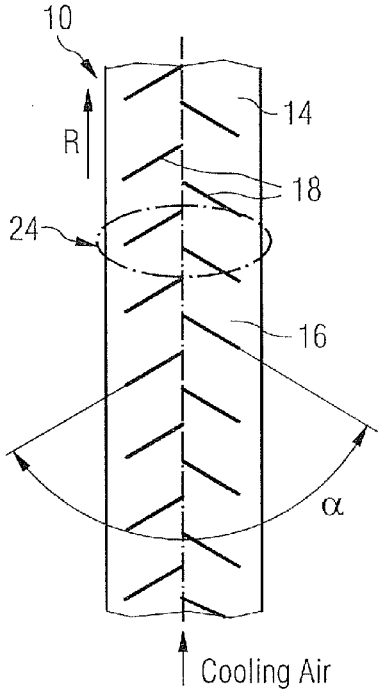
FIG. 3 shows a longitudinal section through the turbine blade along its flow inlet edge.

FIG. 1 shows a rough sectional view of a turbine blade 10 according to the invention through its flow inlet edge 12. The section according to the plane of section A-A of FIG. 1 is shown in FIG. 3, wherein this is a rough sectional view of the front section of a turbine blade 10 according to the invention. Inside the turbine blade 10, a cooling passage 14, which extends parallel to the flow inlet edge 12 (that is to say a radially extending passage 14 in the case of turbines which are axially exposed to throughflow), is formed close to the flow inlet edge 12. Along the cooling passage 14, a number of rib pairs 24 (blanked out in FIG. 1) are arranged one after the other in this, wherein the individual ribs 18 of each rib-pair 24 are positioned transversely to each other by a prespecified angle $\alpha$. Moreover, the ribs 18 of a rib-pair 24, as seen along the extent of the cooling passage, are arranged in an offset manner to each other. The ribs 18 of each pair 24, and also the ribs 18 of directly adjacent pairs 24, in this case are therefore arranged in an overlapping manner in skating step form.

The ribs 18 according to the invention are formed as guiding elements for the cooling air which flows in the center of the cooling passage 14, in order to mutually guide the significant portion of the cooling air which flows there onto the side surfaces of the consecutive ribs 18. The ribs 18 according to the invention correspondingly project significantly further into the cooling passage 18 than the turbulators of EP 1 637 699 A2 which, compared with the ribs 18, are to be characterized only as near-surface and, moreover, do not guide or deflect any significant portion of the cooling air.

During exposure of the cooling passage 14 to throughflow, the cooling air is deflected in turn by the individual ribs 18 of each pair 24. On the ribs 18 which are exposed to inflow in an impingement-cooling-like manner, that is to say transversely exposed to inflow, a high degree of turbulence develops, which in combination with impingement cooling effects and the accompanying surface enlargement on the cooling air side leads to an efficient utilization of the cooling air. In the present case, the angle $\alpha$ in the center region of the turbine blade 10 is greater than in the edge regions of the turbine blade 10 in order to thus cool the center region of the flow inlet edge 12, which as a rule is intensely heated during operation, more intensely than the edge regions of the flow inlet edge 12. As a result of an increase of the angle $\alpha$, the cooling air is deflected more sharply, with an accompanying more intense swirling, which ultimately results in a more pronounced increase of the local heat transfer coefficient in comparison to smaller angles. Finally, in this way the inhomogeneous temperature distribution which develops along the flow inlet edge 12 when the turbine blade 10 is in use can be counteracted according to the invention. Suitable values for the angle $\alpha$, which are adapted to the respective cooling requirement, according to the invention lie within the range of about 60° to 90°.

Figure 2:
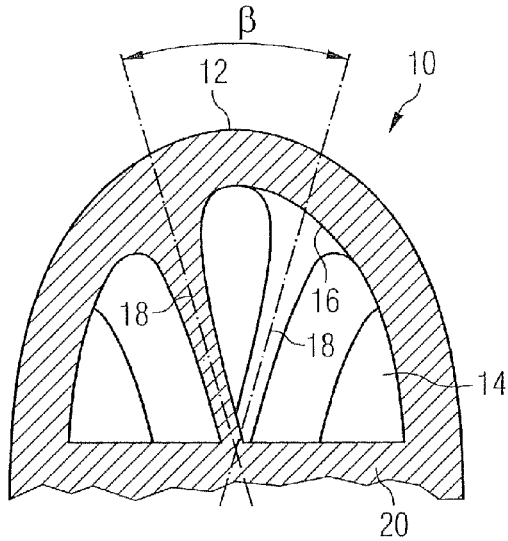
FIG. 2 shows a turbine blade with a cooling passage and with ribs arranged therein.
Figure 4:
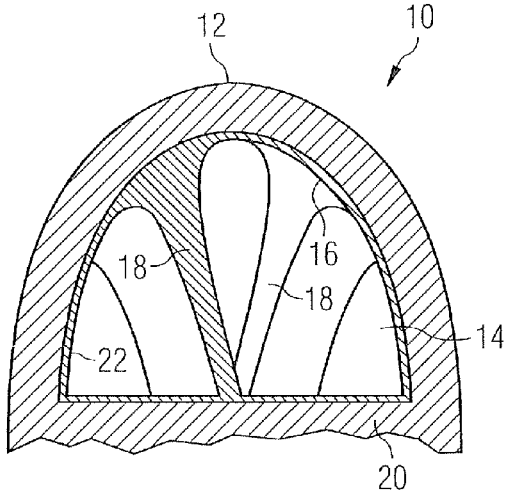
FIG. 4 shows a turbine blade with ribs that are part of an insert.

In FIG. 2, the rough sectional view of the front section of the turbine blade 10 according to the invention according to FIG. 1 is shown in detail, with a flat plane of section at right angles to the flow inlet edge 12. As is to be gathered from this drawing, the individual ribs 18 of a pair 24 extend predominantly from a front wall 16 of the cooling passage 14 to a rear wall 20 of the cooling passage 14. Alternatively, the ribs 18, however, may be fastened only on the front wall 16 on one side without extending to the rear wall 20. Likewise, as shown in FIG. 4, the ribs can also be part of an insert 22 which can be inserted into the cooling passage 14.

In addition to the variation of the cooling capability via the angle $\alpha$, by suitable adjustment of the angular position $\beta$ the cooling air can preferably be guided in the direction of the front wall 16 in order to achieve a cooling of the flow inlet edge 12 which is as effective as possible. According to the invention, intended angle values in this case lie within the range of about 30° to 60°.

The invention claimed is:

1. A turbine blade, comprising:

a leading edge;

a cooling passage extending along a length of the leading edge; and a plurality of ribs arranged one after the other in the cooling passage, wherein two adjacent ribs form a rib-pair, wherein each individual rib of the rib-pair is arranged transversely to each other by a predetermined first angle and, as seen in along an extent of the cooling passage, in an offset manner from each other whereby their respective ends do not touch, wherein the rib-pair is formed as a guiding element for a core flow of a cooling medium flowing in the cooling passage so that the plurality of ribs guide the core flow from a first rib of the rib-pair essentially transversely to a second rib of the rib-pair, and wherein each individual rib extends from a front wall to a rear wall, each wall forming a border of the cooling passage, and wherein the plurality of ribs project into the cooling passage.

2. The turbine blade as claimed in claim 1, wherein the rib-pair includes the predetermined first angle whereby an overall cooling capability of the rib-pair is adapted, using the first angle, to a predetermined cooling requirement for the leading edge in a vicinity of the rib-pair.

3. The turbine blade as claimed in claim 2, wherein the first angle lies within a range of about 60° to 90°, and wherein a cooling capability of a rib-pair is increased by increasing the first angle.

4. The turbine blade as claimed in claim 2, wherein the first angle is greater for the plurality of rib-pairs in a center region of the turbine blade than for the plurality of rib-pairs in an edge region of the turbine blade.

5. The turbine blade as claimed in claim 1, wherein the plurality of ribs including the wall are formed as one piece.

6. The turbine blade as claimed in claim 1, wherein the cooling passage extends essentially parallel to the leading edge throughout the turbine blade.

7. The turbine blade as claimed in claim 1, wherein an adjustment of a second angle in the range of about 30° to 60° is used to guide a cooling air in a direction of the front wall in order to cool the leading edge.

8. A turbine blade, comprising:

a leading edge;

a cooling passage extending along a length of the leading edge; and a plurality of ribs arranged one after the other in the cooling passage, wherein two adjacent ribs form a rib-pair, wherein each individual rib of the rib-pair is arranged transversely to each other by a predetermined first angle and, as seen in along an extent of the cooling passage, in an offset manner from each other whereby their respective ends do not touch, wherein the rib-pair is formed as a guiding element for a core flow of a cooling medium flowing in the cooling passage so that the plurality of ribs guide the core flow from a first rib of the rib-pair essentially transversely to a second rib of the rib-pair, wherein a plurality of rib-pairs are attached inside an insert which is inserted into the cooling passage, and wherein the plurality of ribs project into the cooling passage.

9. The turbine blade as claimed in claim 8, wherein the insert is removable.

* * * * *